US009265364B2

(12) United States Patent
Tan

(10) Patent No.: US 9,265,364 B2
(45) Date of Patent: Feb. 23, 2016

(54) SINGLE DRAWER DISPENSER RACK

(71) Applicant: Stephanie Tan, Harahan, LA (US)

(72) Inventor: Stephanie Tan, Harahan, LA (US)

( * ) Notice: Subject to any disclaimer, the term of this patent is extended or adjusted under 35 U.S.C. 154(b) by 0 days.

(21) Appl. No.: 14/497,713

(22) Filed: Sep. 26, 2014

(65) Prior Publication Data

US 2015/0076169 A1 Mar. 19, 2015

Related U.S. Application Data

(63) Continuation of application No. PCT/US2013/060582, filed on Sep. 19, 2013.

(51) Int. Cl.

| | |
|---|---|
| ***A47K 10/24*** | (2006.01) |
| ***B65H 1/00*** | (2006.01) |
| ***A47F 9/04*** | (2006.01) |
| *A47F 1/04* | (2006.01) |
| *A47F 13/08* | (2006.01) |
| *B65D 83/08* | (2006.01) |

(52) U.S. Cl.

CPC . *A47F 9/042* (2013.01); *A47F 1/04* (2013.01); *A47F 13/085* (2013.01); *B65D 83/08* (2013.01)

(58) Field of Classification Search

CPC ..... A47F 9/042; A47F 1/121; A47F 13/085; A47F 1/04; B65D 83/08

USPC ..... 211/85.5, 12, 123, 106; 221/47, 45, 1; 248/100

See application file for complete search history.

(56) References Cited

U.S. PATENT DOCUMENTS 3,145,840 A 8/1964 Wright
3,341,003 A 9/1967 Marsh
3,514,015 A * 5/1970 Hein ..... A47F 1/04 211/51
3,777,439 A 12/1973 Fried
3,935,838 A * 2/1976 Johnson ..... A01K 5/0241 119/54
4,058,235 A * 11/1977 Cassia ..... A47K 10/42 131/238
4,363,405 A 12/1982 Christie
4,454,974 A * 6/1984 Cooke ..... A47K 10/40 225/106
4,512,476 A 4/1985 Herrington
4,537,330 A 8/1985 Gelbard
4,596,333 A 6/1986 Gilreath
4,722,372 A * 2/1988 Hoffman ..... A47K 5/1209 137/562
4,785,971 A 11/1988 Konarik (Continued)

FOREIGN PATENT DOCUMENTS

FR 2873663 A1 * 2/2006 ..... A47F 9/042
GB 2274098 A * 7/1994 ..... A47F 13/085

(Continued)

*Primary Examiner* — Rakesh Kumar

(74) *Attorney, Agent, or Firm* — David A. Belasco; Belasco Jacobs & Townsley, LLP

(57) ABSTRACT

A bag dispenser includes a platform having first support surface, a first side, a second side, a first end and a second end. A mounting spike or barrier pole fixture may be attached orthogonally adjacent the platform. A wall mounting plate has a series of apertures to attach the plate to a vertical surface with fasteners. The plate is attached orthogonally to the second end of the bag platform. At least one side support extends outwardly from the first and second sides of the bag platform and upwardly from the platform. The side support defines a space for at least one stack of bags. A dispenser cover is affixed over the dispenser and may have a service aperture. The dispenser accommodates conventional, t-shirt and header-style bags in various configurations. The bags are assembled in bag stacks. The stacks may be configured in packs with removable covers or loaded in boxes.

16 Claims, 19 Drawing Sheets

(56) References Cited

U.S. PATENT DOCUMENTS

| | | | | | |
|---|---|---|---|---|---|
| 5,092,548 | A | | 3/1992 | Bayes | |
| 5,269,423 | A | | 12/1993 | Nguyen | |
| 5,405,021 | A | | 4/1995 | Smithson | |
| 5,467,956 | A | * | 11/1995 | Herr | A47K 10/3836 211/16 |
| 5,509,570 | A | | 4/1996 | DeMatteis | |
| 5,524,763 | A | | 6/1996 | Wile | |
| 5,529,221 | A | * | 6/1996 | Roy | G01F 11/24 222/181.2 |
| 5,584,402 | A | | 12/1996 | Johnson | |
| 5,695,065 | A | | 12/1997 | Kennedy | |
| 5,857,586 | A | | 1/1999 | Scherr | |
| 5,938,094 | A | | 8/1999 | Forhan | |
| 6,098,806 | A | | 8/2000 | Mills | |
| 6,179,126 | B1 | | 1/2001 | Smithson | |
| 6,401,971 | B1 | | 6/2002 | Edwards | |
| 6,543,638 | B2 | | 4/2003 | Wile | |
| 6,571,984 | B1 | | 6/2003 | Winesett | |
| 6,619,479 | B2 | | 9/2003 | Jones | |
| 6,655,546 | B1 | * | 12/2003 | Bolton | B65D 83/0847 206/554 |
| 7,172,092 | B2 | | 2/2007 | Yang | |
| 7,175,025 | B2 | | 2/2007 | Chum | |
| D551,007 | S | | 9/2007 | Trinko | |
| 7,275,657 | B2 | | 10/2007 | Geyer | |
| 8,534,462 | B1 | * | 9/2013 | Tan | B65D 83/0847 206/494 |
| 2001/0023873 | A1 | * | 9/2001 | Wile | A47F 5/01 221/26 |
| 2003/0224962 | A1 | | 12/2003 | Fryc | |
| 2004/0040974 | A1 | | 3/2004 | Chen | |
| 2004/0226961 | A1 | * | 11/2004 | Mehus | B01F 1/0027 222/77 |
| 2007/0176058 | A1 | | 8/2007 | Kohn | |
| 2007/0181594 | A1 | * | 8/2007 | Thompson | A47K 10/40 221/190 |
| 2009/0212063 | A1 | * | 8/2009 | Cohen | A47K 10/424 221/45 |
| 2010/0032445 | A1 | | 2/2010 | Bunoz | |
| 2010/0270181 | A1 | | 10/2010 | Morgan | |
| 2012/0111811 | A1 | | 5/2012 | Tan | |
| 2012/0118839 | A1 | | 5/2012 | Tan | |
| 2013/0153593 | A1 | * | 6/2013 | Silagy | B65D 83/0817 221/1 |
| 2013/0284756 | A1 | * | 10/2013 | Springer | B65D 83/08 221/34 |
| 2014/0021215 | A1 | * | 1/2014 | Tran | A47K 10/42 221/45 |
| 2015/0076169 | A1 | * | 3/2015 | Tan | A47F 9/042 221/1 |
| 2015/0108156 | A1 | * | 4/2015 | Tan | A47F 13/085 221/26 |

FOREIGN PATENT DOCUMENTS

| | | | | | |
|---|---|---|---|---|---|
| GB | 2309216 | A | * | 7/1997 | A47F 13/085 |
| GB | 2349144 | A | * | 10/2000 | A47F 9/042 |
| GB | 2385314 | A | * | 8/2003 | A47F 9/042 |
| WO | WO 2004007299 | A2 | * | 1/2004 | A47F 9/042 |

* cited by examiner

SINGLE DRAWER DISPENSER RACK

RELATED APPLICATION

The instant application is a continuation of PCT/US2013/060582, filed Sep. 19, 2013, and incorporates the same by reference in its entirety.

FIELD OF INVENTION

This invention relates to the field of plastic and other film bag storage and dispensing and more specifically to merchandise and produce bag dispensers adapted to attach to a vertical surface.

BACKGROUND OF THE INVENTION

In supermarkets and grocery stores space for the mounting of bag dispensers is usually at a premium. It is desirable to use as much of the space available as possible for the display of produce or the handling of other groceries. However, certain facilities must be provided to the store's customers and checkout personnel for efficient produce sales and merchandise handling. One such facility is the provision of produce bags that may be conveniently used by the customers to collect the produce that they wish to purchase. Another facility is a checkout counter that has a bag dispensing rack mounted into a vertical counter surface, thereby providing unencumbered horizontal counter space for the handling of the customer's merchandise. Ideally, the store would like to provide simple to use produce and merchandise bag dispensers that are easy to maintain, hold a large quantity of bags of a sufficient size and which do not require frequent servicing.

In addition, grocery stores would like to use space for the bag dispensers not readily usable for the display of produce or other merchandise. It is most convenient to display produce and other items on angled or substantially horizontal shelves. Vertical surfaces, such as the walls of display stands and shelves are good locations to position bag dispensers as such surfaces are not readily usable for other displays. A bag dispenser that can be readily mounted to a vertical surface near a checkout counter will often make use of otherwise unusable space.

A number of dispensing devices and produce bags have been designed to efficiently provide produce bags and merchandise bags to shopping customers.

U.S. Pat. No. 5,584,402, issued to Johnson, discloses a bag storage and dispensing rack that may be mounted from a vertical support surface or wall. A base member is supported on a pair of brackets which allows the rack to be displaced in a drawer-like fashion.

U.S. Pat. No. D551,007, issued to Trinko is directed to a bag dispensing rack that is designed to be mounted on a vertical wall or surface so that the rack portion and the bags held within are in a horizontal orientation. The reference is directed to a "rack" while the bag dispenser itself is shown only in dashed lines for illustrative purposes.

U.S. Pat. No. 6,401,971, issued to Edwards et al. illustrates a bag storage and dispensing system with a bag-like structure in another example of the bag stack being held in a horizontal orientation. The storage and dispensing system includes a top flap that is hingedly attached to the front end panel. The top flap includes a slotted aperture. The bags are loaded onto the tongue by aligning the apertures with the tongue and positioning the bags so as to be horizontally presented and retrieved through the aperture. The aperture has an opening in the front wall so as to make it more convenient to remove individual bags.

U.S. Pat. No. 6,098,806, issued to Mills disclose a storage and dispensing unit for merchandise bags that includes a window through which the bag pack may be exposed and another window through which the individual bags may be grasped. The stack of bag tabs is retained within the housing by means of a stiff wire loop that is retained within the housing by being captured between the bottom wall and the housing and a corrugated cardboard insert which is glued or otherwise secured to the bottom wall.

U.S. Pat. No. 7,172,092, issued to Yang et al. is directed to an upright container for storing and dispensing bags. The device is intended to be mounted on a vertical wall with the bags contained therein being visible through an aperture. The device also includes an aperture through which the individual bags may be retrieved.

U.S. Pat. No. 3,777,439, issued to Fried discloses a bag-opening dispenser and method and provides an example of a drawer-like structure that holds a plurality of merchandise bags in a horizontally oriented manner. The bags are retrievable individually by grasping the upper wall of the bag at the cutout portion.

U.S. Pat. No. 6,619,479, issued to Jones et al. discloses a promotional bag dispensing apparatus wherein a bag dispenser may include a panel with identification or promotional type indicia on a front or top exposed surface.

It is an objective of the present invention to provide a compact system for dispensing plastic produce bags or merchandise bags that can be mounted conveniently to a vertical surface. It is a further objective to provide such a system that can store an increased number of relatively large produce or merchandise bags adjacent a check-out counter. It is a still further objective of the invention to provide a dispenser system that provides a visual indication when the bag pack needs to be replaced. Finally, it is an objective to provide such a system that can be easily fabricated, is durable, inexpensive and simple to service.

While some of the objectives of the present invention are disclosed in the prior art, none of the inventions found include all of the requirements identified.

SUMMARY OF THE INVENTION

The present invention addresses all of the deficiencies of prior art bag dispensing inventions and satisfies all of the objectives described above.

(1) A bag dispenser providing the desired features may be constructed from the following components. A bag platform is provided. The platform has a first support surface, a first side, a second side, a first end and a second end. A wall mounting plate is provided. The plate has an upper end, a lower end and a series of apertures penetrating the plate for use in attaching the plate to a vertical surface. The plate is attached orthogonally to the second end of the bag platform. At least one fastener for attaching the plate to the vertical surface is provided. At least one side support is provided. The side support extends outwardly from the first and second sides of the bag platform and upwardly from the platform. The at least one side support defines a space sized and shaped to accommodate at least one stack of bags. A dispenser cover is provided. The cover is sized and shaped to extend from the first end to the second end of the bag platform and from at least a first end to at least a second end of the at least one side support. The dispenser cover has a central aperture permitting either of viewing of or access to the stack of bags.

(2) In another variant, the bag platform extends downwardly at the second end, providing at least one attachment point for the wall mounting plate.

(3) In a further variant, the at least one side support extends across and attaches to the bag platform.

(4) In still another variant, the at least one side support is of wire frame construction.

(5) In yet another variant, the dispenser cover is pivotally attached to the first end of the at least one side support.

(6) In a further variant, the at least one side support has a latching mechanism adjacent the second end for securing the dispenser cover.

(7) In yet a further variant, the dispenser cover is hingedly attached to the at least one side support at the first end of the side support.

(8) In yet a further variant, the dispenser cover has a cutout at one edge for lifting the cover.

(9) In another variant of the invention, the latching mechanism is magnetic.

(10) In still another variant, the latching mechanism comprises loop and eye fittings.

(11) In yet another variant, a mounting spike fixture is provided. The mounting spike fixture is attached orthogonally adjacent the platform and has at least one mounting spike extending upwardly from it.

(12) In a further variant, a barrier pole fixture is provided. The barrier pole fixture is attached orthogonally adjacent the platform and has at least one barrier pole extending upwardly from it.

(13) In still a further variant, the at least one mounting spike is movably attached to the mounting spike fixture.

(14) In yet a further variant, at least one barrier pole is movably attached to the barrier pole fixture.

(15) In another variant of the invention, a bag dispenser includes a bag platform. The platform has a first support surface, a first side, a second side, a first end and a second end. At least one side support is provided. The side support extends outwardly from the first and second sides of the bag platform and upwardly from the platform. The at least one side support defines a space sized and shaped to accommodate at least one stack of bags. At least one overhead mounting feature is provided. The mounting feature is attached to the at least one side support and has a series of apertures penetrating the mounting feature for use in attaching to an overhead horizontal surface. At least one fastener is provided for attaching the mounting feature to the horizontal surface. An end panel is provided. The end panel is pivotally attached to either of the first and second ends of the bag platform. A latching mechanism is provided. The latching mechanism maintains the end panel in a first, upright position. The latching mechanism includes loop and eye fittings. In yet another variant, the latching mechanism is magnetic.

(16) In still a further variant, the end panel further includes an aperture for access to the at least one stack of bags.

(17) In yet a further variant, a bag dispenser includes a bag platform. The platform has a first support surface, a first side, a second side, a first end and a second end. At least one side support is provided. The side support extends outwardly from the first and second sides of the bag platform and upwardly from the platform. The at least one side support defining a space sized and shaped to accommodate at least one stack of bags. At least one overhead mounting feature is provided. The mounting feature is attached to the at least one side support and has a series of apertures penetrating the mounting feature for use in attaching to an overhead horizontal surface. At least one fastener is provided for attaching the mounting attached to at least one of said first and second side supports. A latching mechanism is provided. The latching mechanism maintains the side panel in a first, upright position. The latching mechanism includes loop and eye fittings.

(18) In a further variant, the side panel further includes an aperture for access to the at least one stack of bags.

(19) In another variant of the invention, the bag dispenser further includes bags for use in the dispenser. The bags include a front wall, a back wall, first and second parallel linear side edges, a top edge and a bottom edge. The front and rear walls are integrally joined at their first and second side edges and secured together at their bottom edges. An open mouth portion is defined adjacent the top edges.

(20) In still another variant, each of the bags includes at least one longitudinally oriented side gusset.

(21) In yet another variant, each of the bags includes a bottom gusset.

(22) In a further variant, each of the bags further includes an upper seam. The upper seam seals the front wall to the back wall at their respective top edges. A U-shaped cut-out is provided. The U-shaped cut-out is located in an upper portion of the bag and commences at a first point along the upper seam spaced inwardly from the first side edge and extends to a second point along the upper seam spaced inwardly from the second side edge. The cut-out extends downwardly toward the bottom edges, thereby forming an open mouth portion and a pair of bag handles.

(23) In still a further variant of the invention, the bag dispenser further includes bags for use in the dispenser. The bags include a front wall, a back wall, first and second parallel linear side edges, a top edge and a bottom edge. At least one of the front and back walls is removably attached to a header. The header extends across at least a portion of at least one of the front and back walls. The header has at least one mounting aperture extending through the header orthogonally and through the bag walls. The mounting aperture is sized, shaped and located to permit the bags to be positioned upon the at least one mounting spike.

(24) In yet a further variant, each of the bags includes at least one longitudinally oriented side gusset.

(25) In another variant, each of the bags includes a bottom gusset.

(26) In still another variant, a plurality of the bags form a bag stack.

(27) In yet another variant, a plurality of the bags attached to the header form a bag stack.

(28) In yet another variant, the bags are packaged into bag packs. The bag packs include at least one stack of bags. The stack is enclosed in a removable outer wrapper.

(29) In yet another variant, the bags are packaged into bag packs. The bag packs include at least one stack of bags. The stack is enclosed in a removable outer wrapper.

(30) In a further variant, the bag stacks are packaged into boxes. The boxes are sized and shaped to fit into the dispenser.

(31) In still a further variant, a method of using a bag dispenser, includes the steps of:

providing a bag platform, the platform has a first support surface, a first side, a second side, a first end and a second end;

providing a wall mounting plate, the plate has an upper end, a lower end and a series of apertures penetrating the plate for use in attaching the plate to a vertical surface, the plate is attached orthogonally to the second end of the bag platform;

providing at least one fastener for attaching the plate to the vertical surface;

providing at least one side support, the side support extends outwardly from the first and second sides of the bag platform and upwardly from the platform, the at least one side support defining a space sized and shaped to accommodate at least one stack of bags;

providing a dispenser cover sized and shaped to extend from the first end to the second end of the bag platform and from at least a first end to at least a second end of the at least one side support. The dispenser cover has a central aperture that permits viewing of or access to the stack of bags;

securing the dispensing cover over the at least one stack of bags;

attaching the wall mounting plate to the vertical surface using the at least one fastener; and positioning the at least one stack of bags in the dispenser.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-8 illustrate a bag dispenser 10 providing the desired features that may be constructed from the following components. A bag platform 14 is provided. The platform 14 has a first support surface 18, a first side 22, a second side 26, a first end 30 and a second end 34. A wall mounting plate 46 is provided. The plate 46 has an upper end 50, a lower end 54 and a series of apertures 58 penetrating the plate 46 for use in attaching the plate 46 to a vertical surface 62. The plate 46 is attached orthogonally to the second end 34 of the bag platform 14. At least one fastener 66 for attaching the plate 46 to the vertical surface 62 is provided. At least one side support 70 is provided. The side support 70 extends outwardly from the first 22 and second 26 sides of the bag platform 14 and upwardly from the platform 14. The at least one side support 70 defines a space 74 sized and shaped to accommodate at least one stack 78 of bags 82. A dispenser cover 86 is provided. The cover 86 is sized and shaped to extend from the first end 30 to the second end 34 of the bag platform 14 and from at least a first end 90 to at least a second end 94 of the at least one side support 70. The dispenser cover 86 has a central aperture 106 permitting either viewing of or access to the stack 78 of bags 82.

Figure 5:
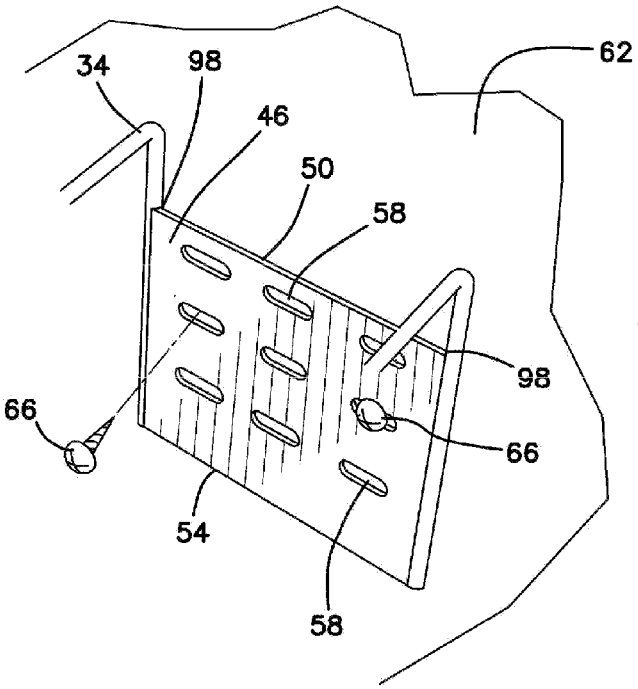
FIG. 5 is a perspective view of the wall mounting plate and fasteners for attaching the FIG. 1 embodiment to a vertical surface.

(2) In another variant of the invention, as illustrated in FIG. 5, the bag platform 14 extends downwardly at the second end 34, providing at least one attachment point 98 for the wall mounting plate 46.

(3) In a further variant, as illustrated in FIGS. 1-4, the at least one side support 70 extends across and attaches to the bag platform 14.

(4) In still another variant, the at least one side support 70 is of wire frame construction.

Figure 1:
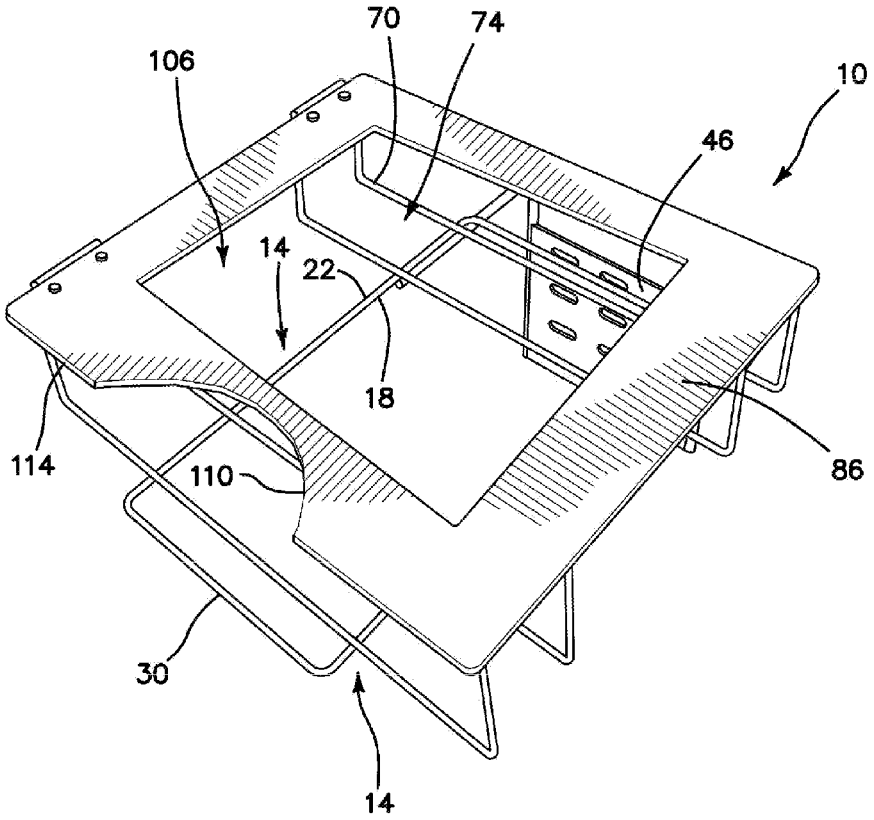
FIG. 1 is a perspective view of the preferred embodiment of the invention with the cover in the closed position.
Figure 2:
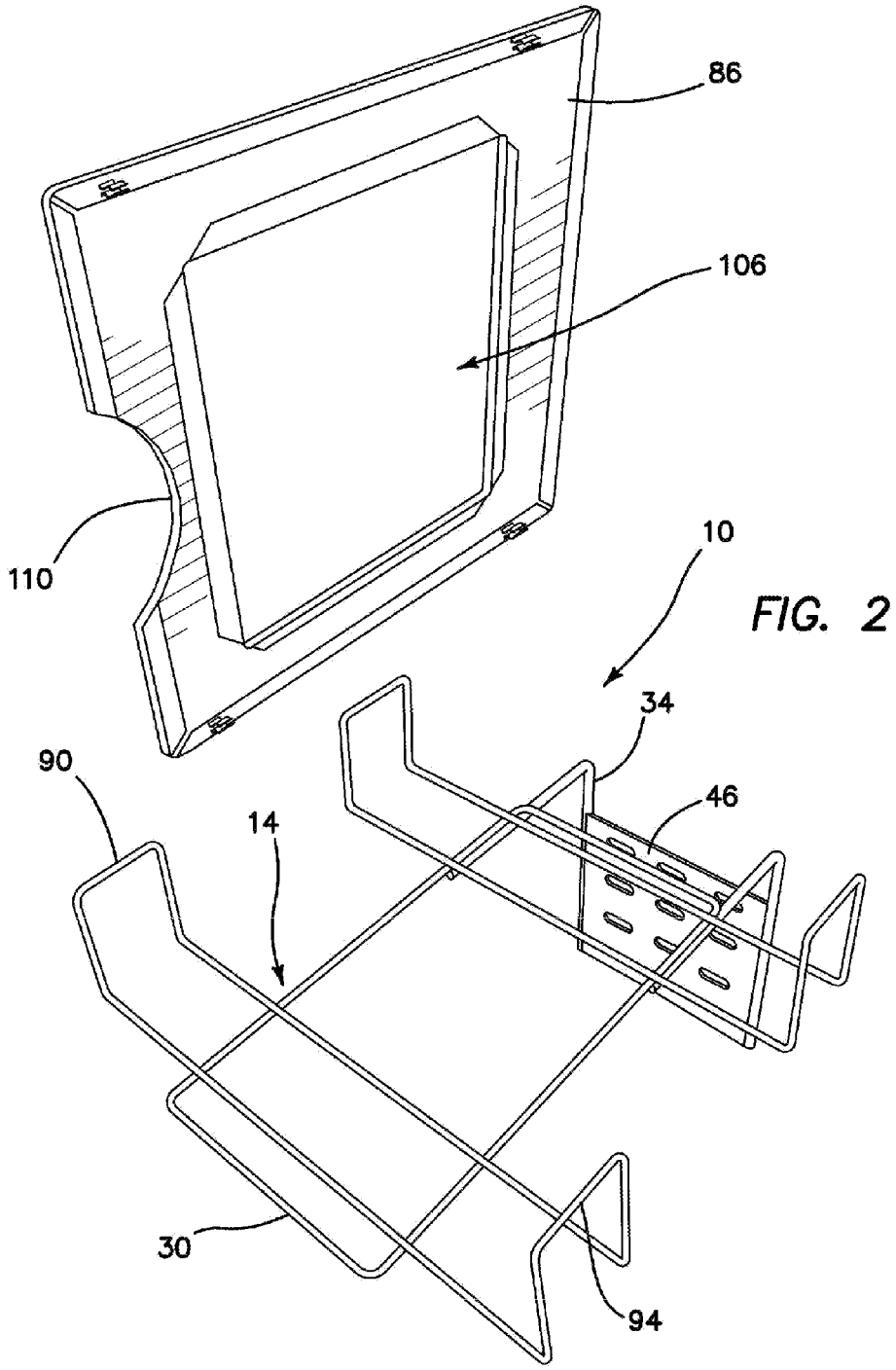
FIG. 2 is an exploded perspective view of the FIG. 1 embodiment of the invention with the cover removed.
Figure 2A:
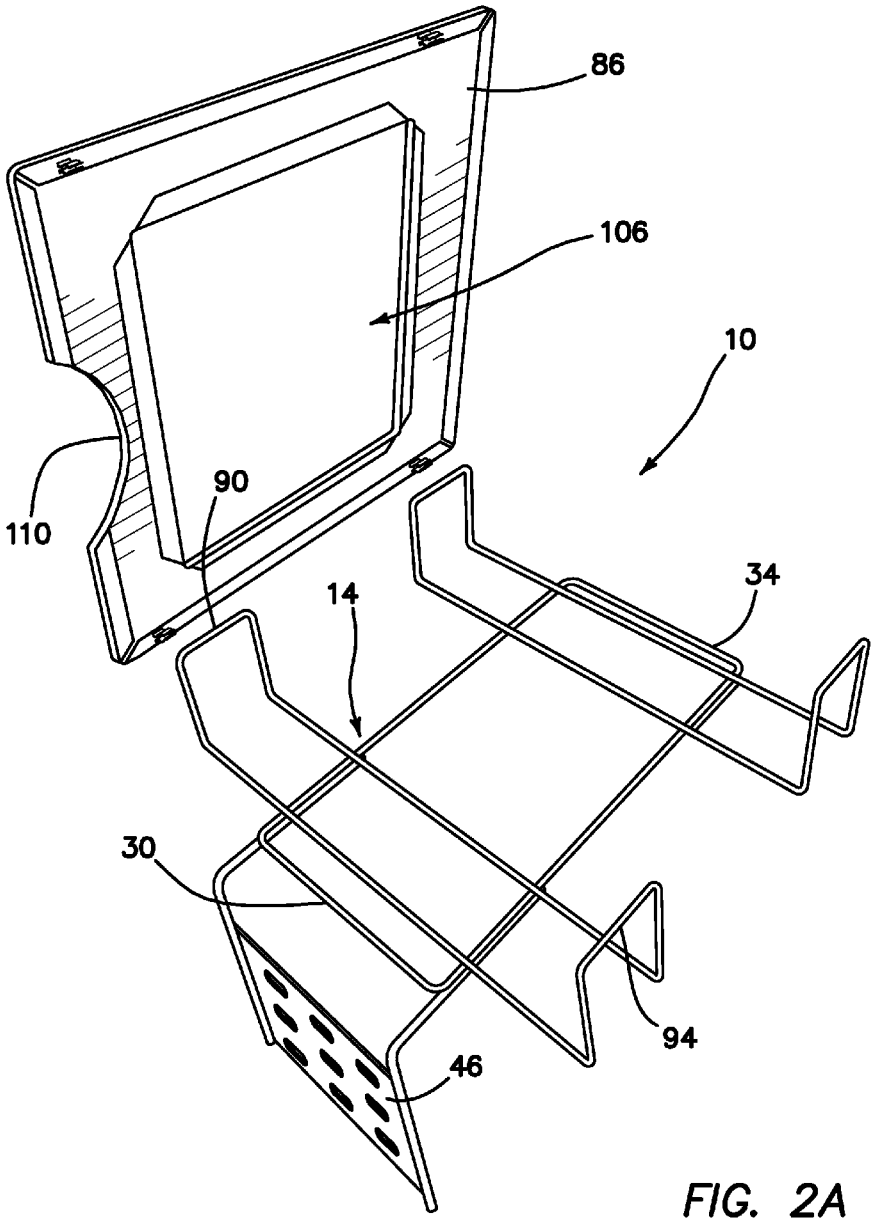
FIG. 2A is an exploded perspective view of the FIG. 1 embodiment of the invention with the cover removed and the wall mounting plate attached at a first end of the bag platform.
Figure 3:
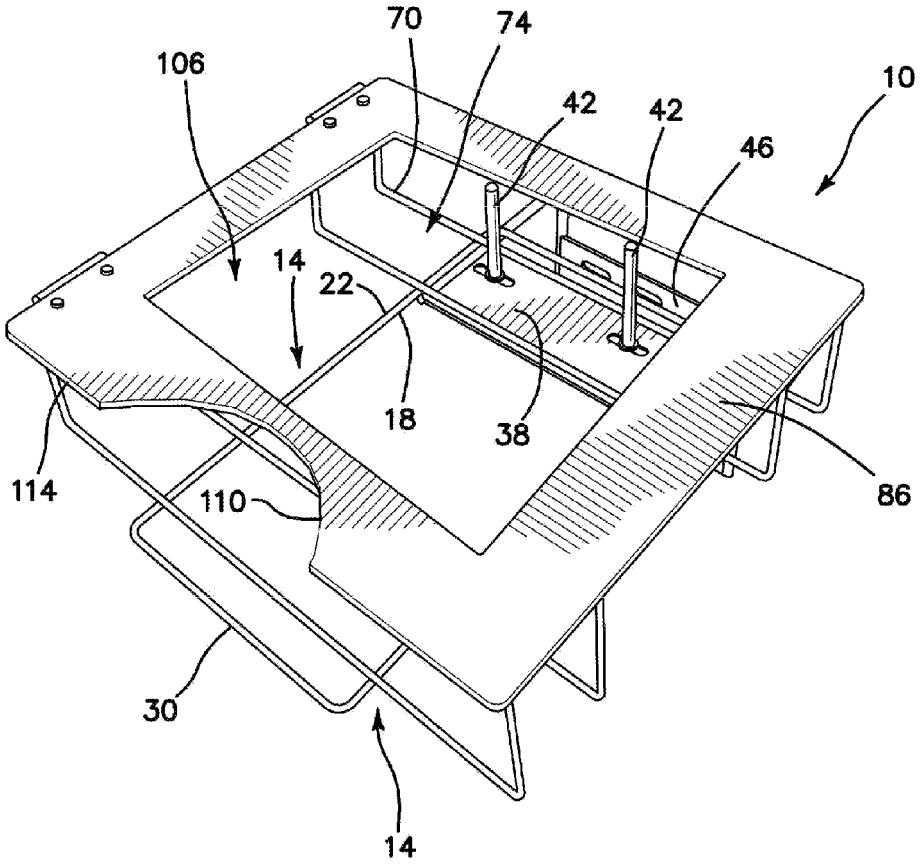
FIG. 3 is a perspective view of the FIG. 1 embodiment with a mounting spike fixture and mounting spikes attached.
Figure 4:
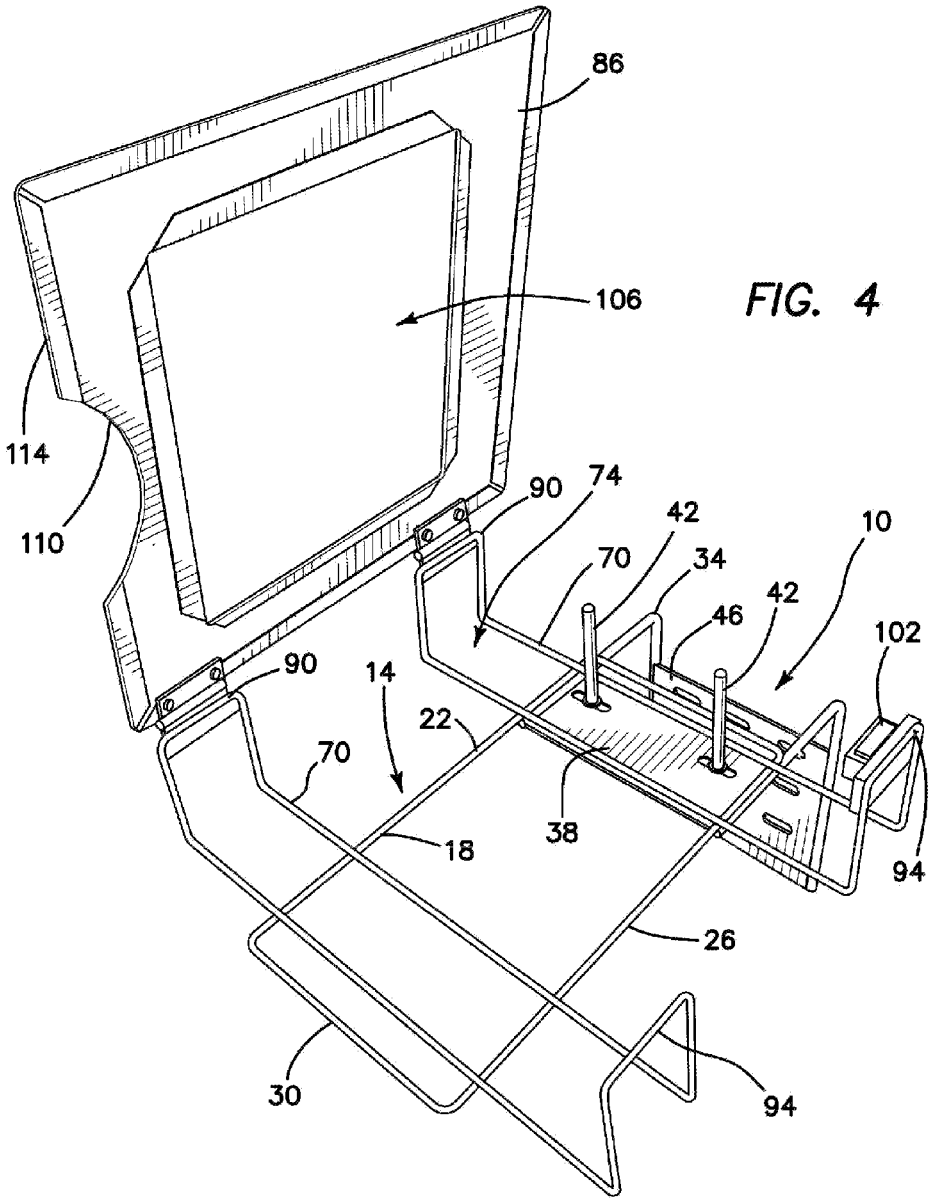
FIG. 4 is a perspective view of the FIG. 3 embodiment with the cover in the open position.
Figure 4A:
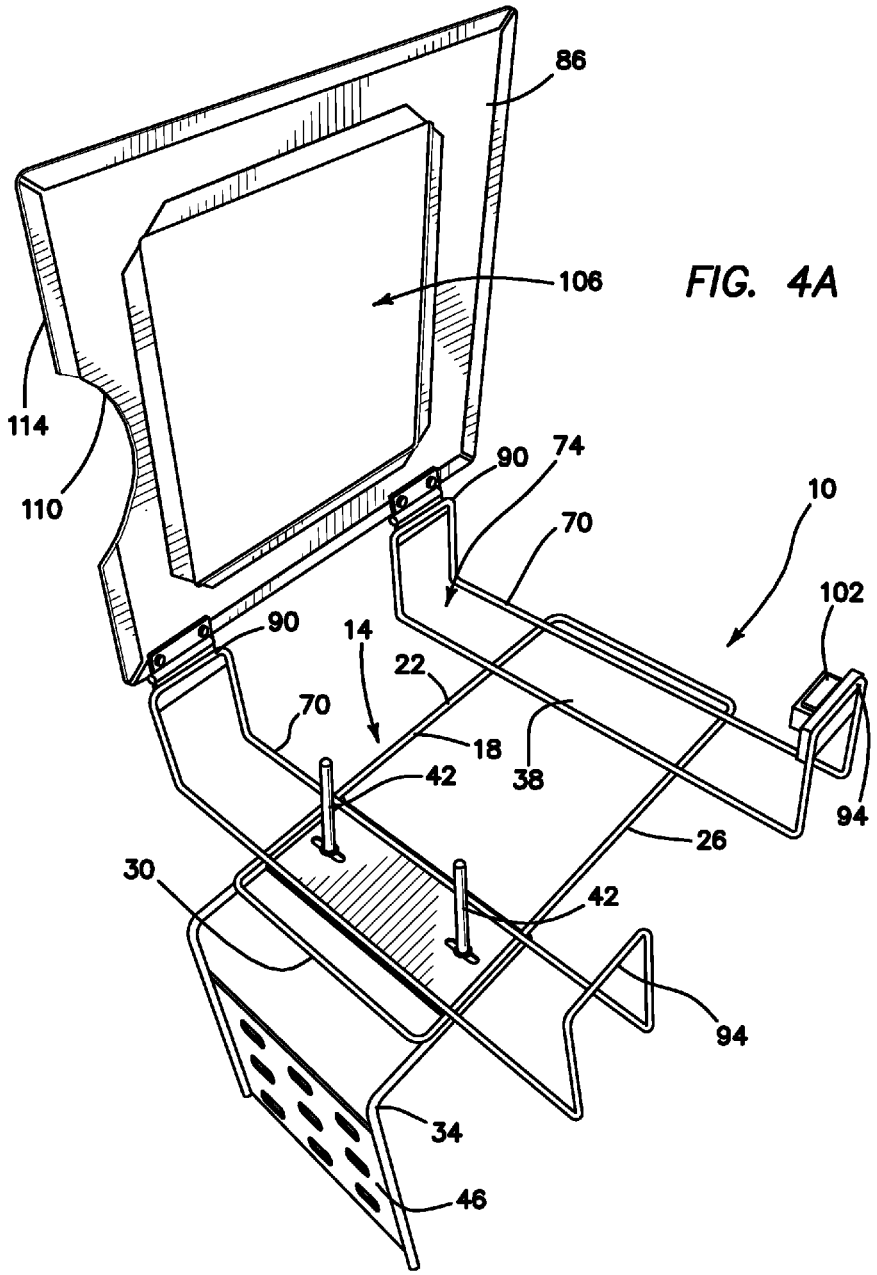
FIG. 4A is a perspective view of the FIG. 3 embodiment with the cover in the open position and the wall mounting plate attached at a first end of the bag platform.

(5) In yet another variant, as illustrated in FIGS. 1, 3 and 4, the dispenser cover 86 is pivotally attached to the first end 90 of the at least one side support 70.

(6) In a further variant, the at least one side support 70 has a latching mechanism 102 adjacent the second end 94 for securing the dispenser cover 86.

(7) In yet a further variant, the dispenser cover 86 is hingedly attached to the at least one side support 70 at the first end 90 of the side support 70.

(8) In yet a further variant, the dispenser cover 86 has a cutout 110 at one edge 114 for lifting the cover 86.

(9) In another variant of the invention, as illustrated in FIG. 4, the latching mechanism 102 is magnetic.

Figure 6:
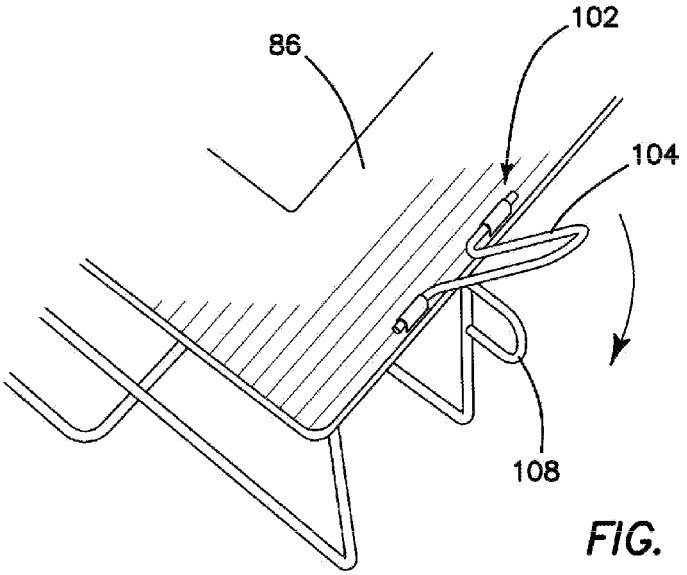
FIG. 6 is a perspective view of a loop and eye latching mechanism for the FIG. 1 embodiment.

(10) In still another variant, as illustrated in FIG. 6, the latching mechanism 102 comprises loop 104 and eye 108 fittings.

(11) In yet another variant, as illustrated in FIGS. 3 and 4, a mounting spike fixture 38 is provided. The mounting spike fixture 38 is attached orthogonally adjacent the platform 14 and has at least one mounting spike 42 extending upwardly from it.

Figure 11:
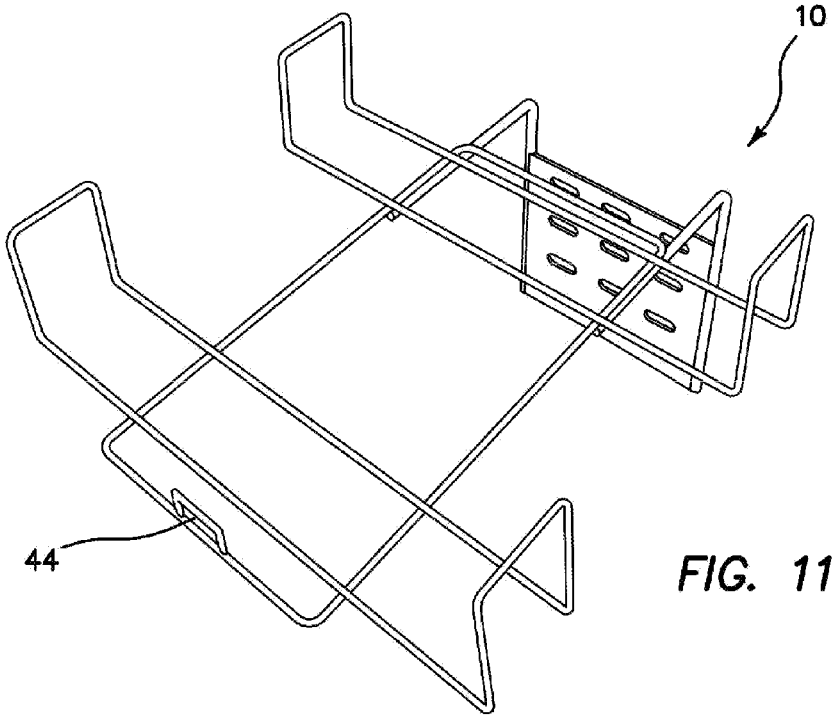
FIG. 11 is a perspective view of the FIG. 1 embodiment with a barrier pole attached.
Figure 12:
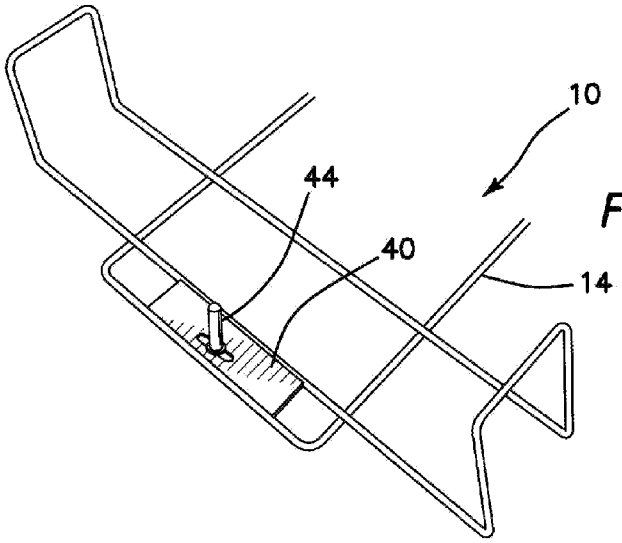
FIG. 12 is a perspective view of the FIG. 1 embodiment with an alternative barrier pole attached.
Figure 13:
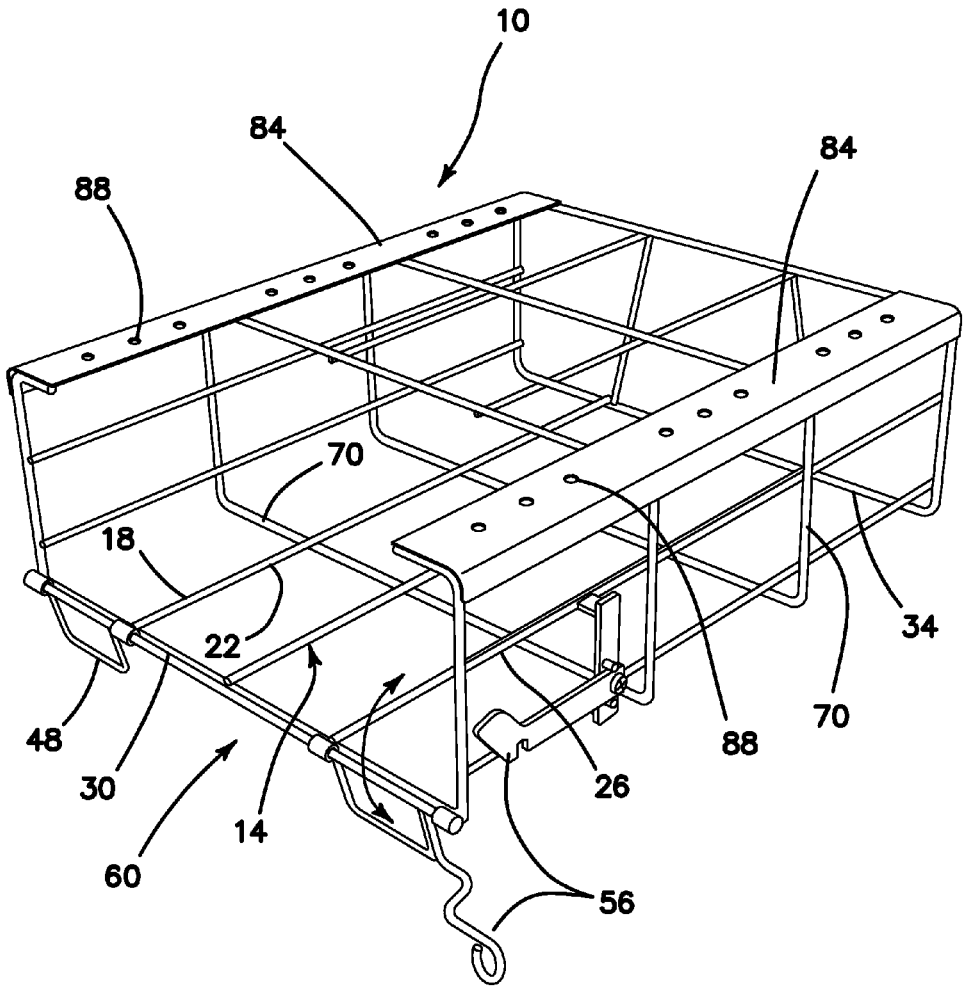
FIG. 13 is a perspective view of an alternative embodiment of the invention having an openable end panel, shown in the open position, for use with bag box containers.
Figure 14:
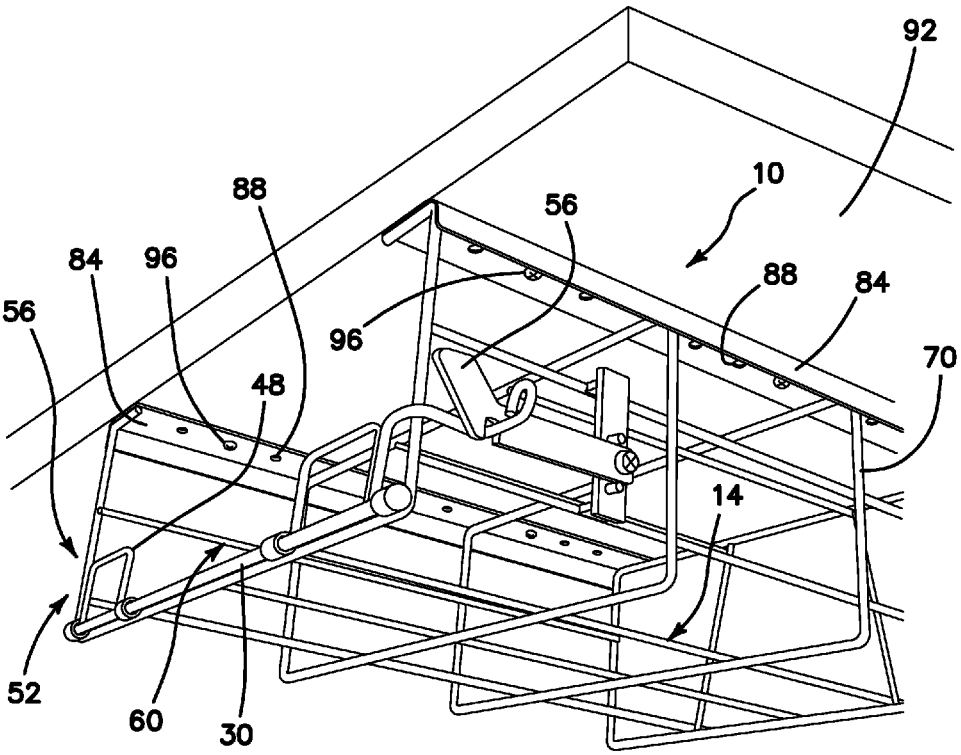
FIG. 14 is a perspective view of the FIG. 13 embodiment attached under a counter illustrating the end panel in the closed position.

(12) In a further variant, as illustrated in FIGS. 11 and 12, a barrier pole fixture 40 is provided. The barrier pole fixture 40 is attached orthogonally adjacent the platform 14 and has at least one barrier pole 44 extending upwardly from it.

(13) In still a further variant, as illustrated in FIGS. 1, 3, 4, 7, and 8, the at least one mounting spike 42 is movably attached to the mounting spike fixture 38.

(14) In yet a further variant, at least one barrier pole 44 is movably attached to the barrier pole fixture 40.

Figure 15:
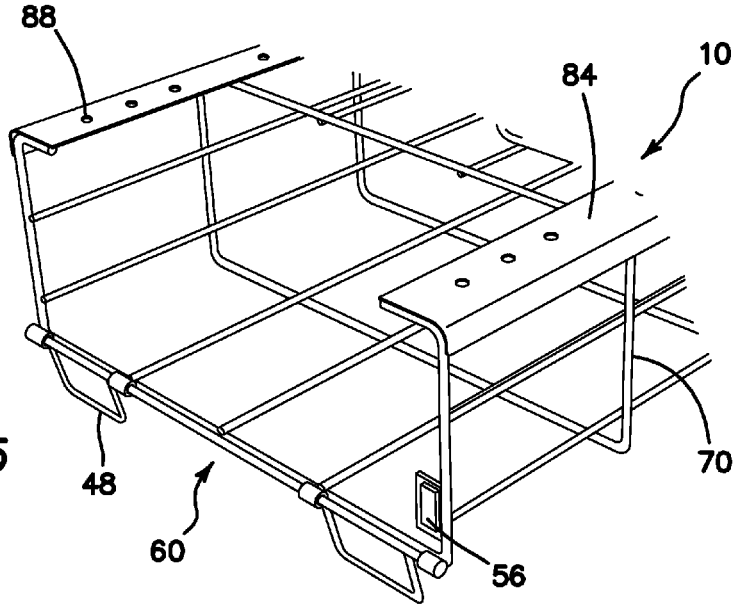
FIG. 15 is a perspective view of the FIG. 13 embodiment illustrating a magnetic latch for the end panel.
Figure 16:
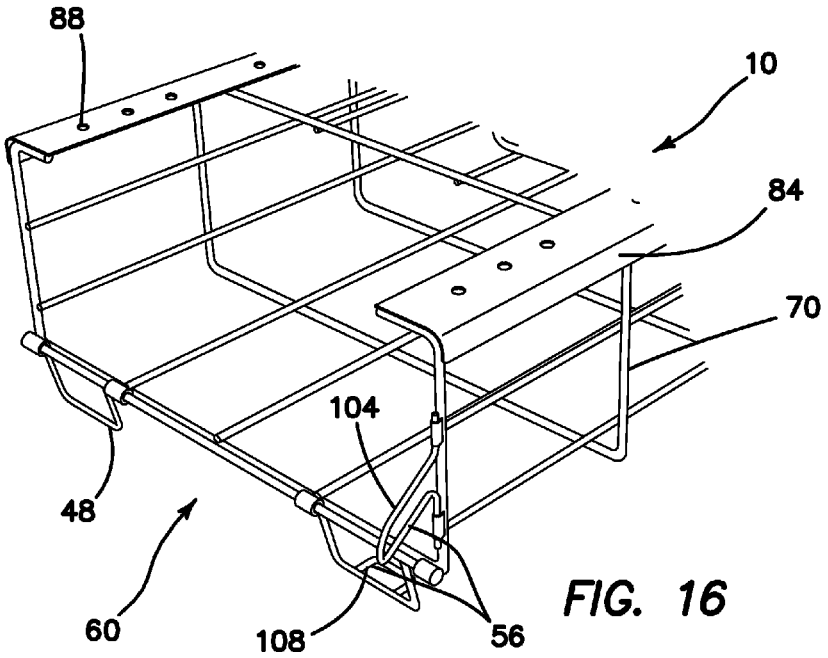
FIG. 16 is a perspective view of the FIG. 13 embodiment illustrating a hook and eye latch for the end panel.

(15) In another variant of the invention, as illustrated in FIGS. 13-16, a bag dispenser 10 includes a bag platform 14. The platform 14 has a first support surface 18, a first side 22, a second side 26, a first end 30 and a second end 34. At least one side support 70 is provided. The side support 70 extends outwardly from the first 22 and second 26 sides of the bag platform 14 and upwardly from the platform 14. The at least one side support 70 defines a space 74 sized and shaped to accommodate at least one stack 78 of bags 82. At least one overhead mounting feature 84 is provided. The mounting feature 84 is attached to the at least one side support 70 and has a series of apertures 88 penetrating the mounting feature 84 for use in attaching to an overhead horizontal surface 92. At least one fastener 96 is provided for attaching the mounting feature 84 to the horizontal surface 92. An end panel 48 is provided. The end panel 48 is pivotally attached to either of the first 30 and second 34 ends of the bag platform 14. A latching mechanism 56 is provided. The latching mechanism 56 maintains the end panel 48 in a first, upright position 52. The latching mechanism 56 includes loop 104 and eye 108 fittings as illustrated in FIG. 16. In yet another variant, as illustrated in FIG. 15, the latching mechanism 56 is magnetic.

(16) In still a further variant, the end panel 48 further includes an aperture 60 for access to the at least one stack 78 of bags 82.

Figure 17:
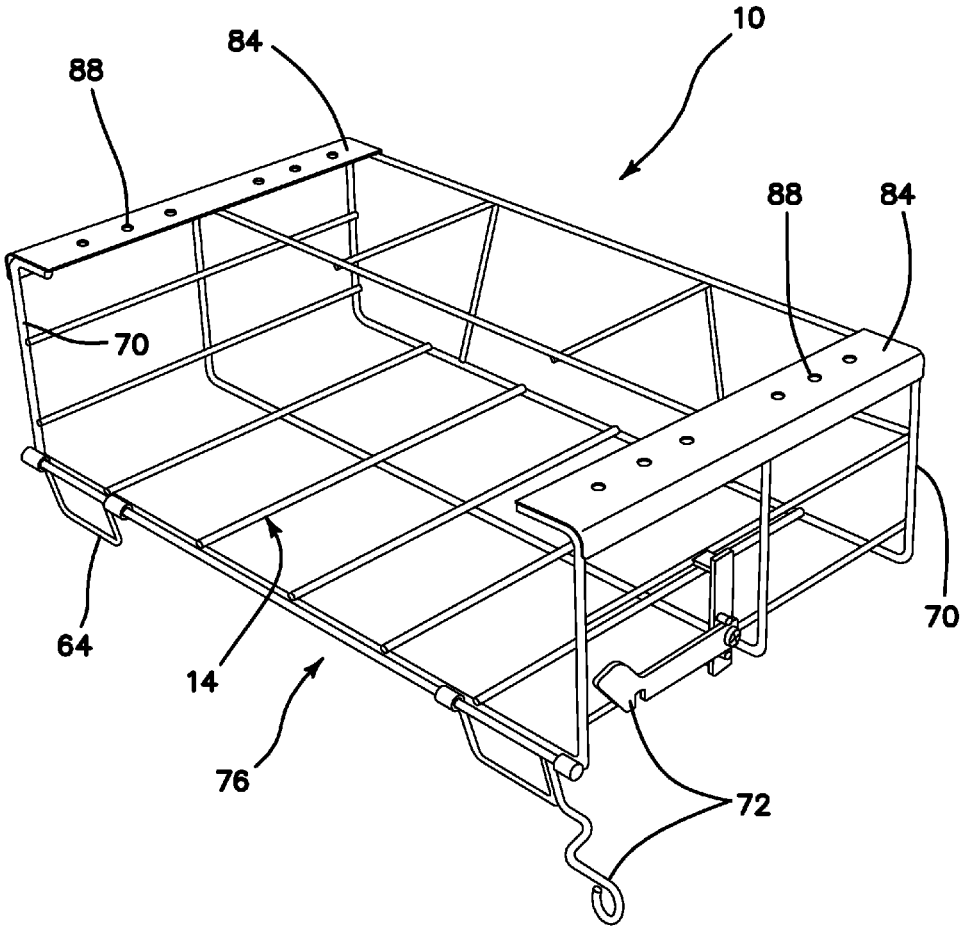
FIG. 17 is a perspective view of an alternative embodiment of the invention having an openable side panel, shown in the open position, for use with bag box containers.
Figure 18:
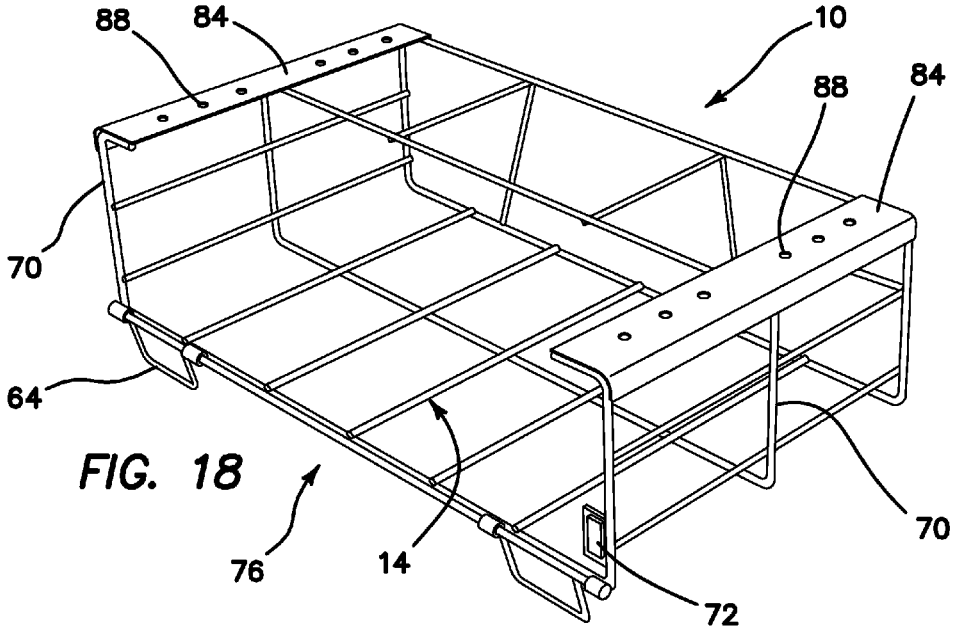
FIG. 18 is a perspective view of the FIG. 17 embodiment illustrating a magnetic latch for the side panel, shown in the closed position.
Figure 19:
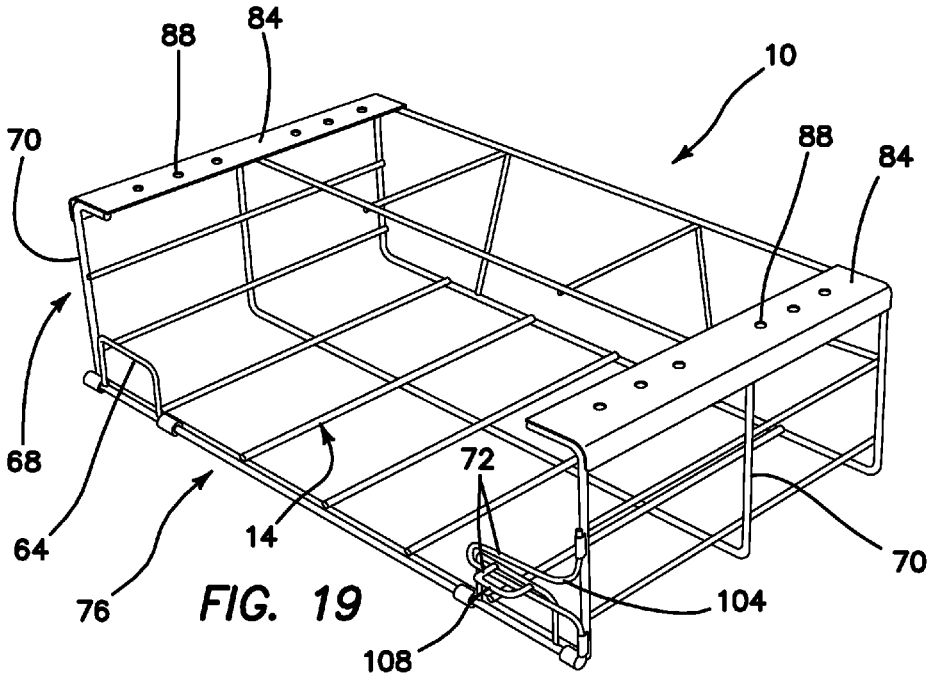
FIG. 19 is a perspective view of the FIG. 17 embodiment illustrating a hook and eye latch for the side panel.

(17) In yet a further variant, as illustrated in FIGS. 17-19, a bag dispenser 10 includes a bag platform 14. The platform 14 has a first support surface 18, a first side 22, a second side 26, a first end 30 and a second end 34. At least one side support 70 is provided. The side support 70 extends outwardly from the first 22 and second 26 sides of the bag platform 14 and upwardly from the platform 14. The at least one side support 70 DEFINES a space 74 sized and shaped to accommodate at least one stack 78 of bags 82. At least one overhead mounting feature 84 is provided. The mounting feature 84 is attached to the at least one side support 70 and has a series of apertures 88 penetrating the mounting feature 84 for use in attaching to an overhead horizontal surface 92. At least one fastener 96 is provided for attaching the mounting feature 84 to the horizontal surface 92. A side panel 64 is provided. The side panel 64 is pivotally attached to at least one of the first and second side supports 70. A latching mechanism 72 is provided. The latching mechanism 72 maintains the side panel 64 in a first, upright position 68. The latching mechanism 72 includes loop 104 and eye 108 fittings as illustrated in FIG. 19. In still another variant, as illustrated in FIG. 18, the latching mechanism 72 is magnetic.

(18) In a further variant, as illustrated in FIGS. 17-19, the side panel 64 further includes an aperture 76 for access to the at least one stack 72 of bags 82.

Figure 7:
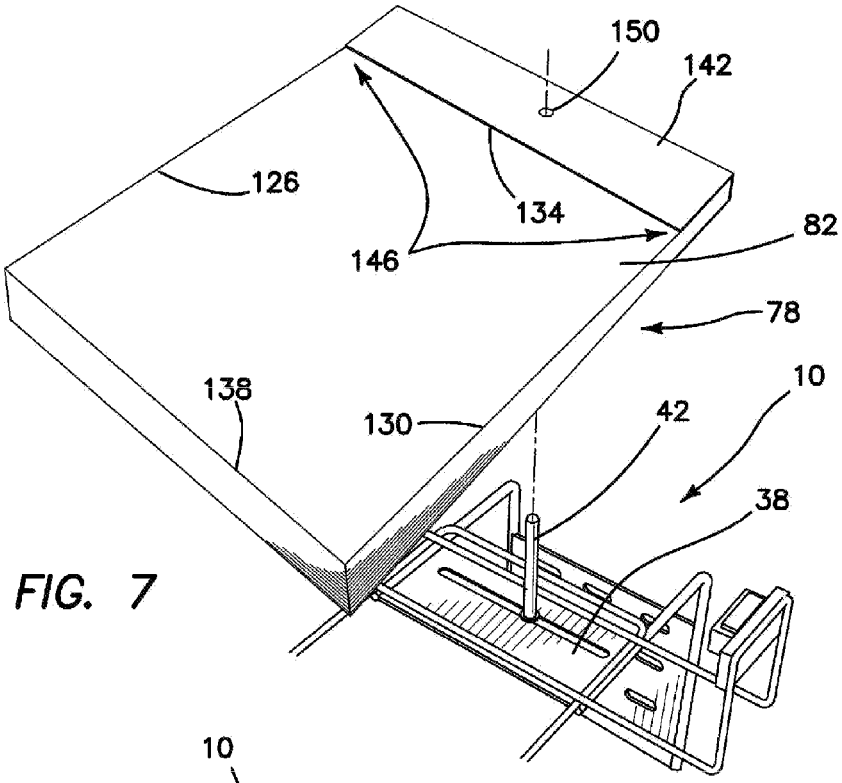
FIG. 7 is an exploded partial perspective view of a bag stack and the mounting spike fixture of the FIG. 3 embodiment.
Figure 8:
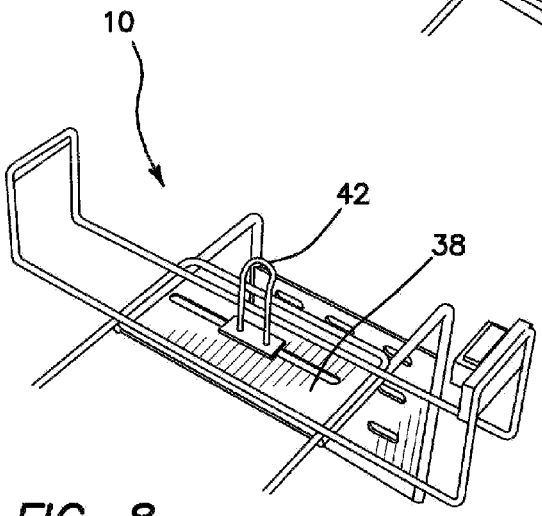
FIG. 8 is a partial perspective view of an alternative mounting spike on the mounting spike fixture.
Figure 9:
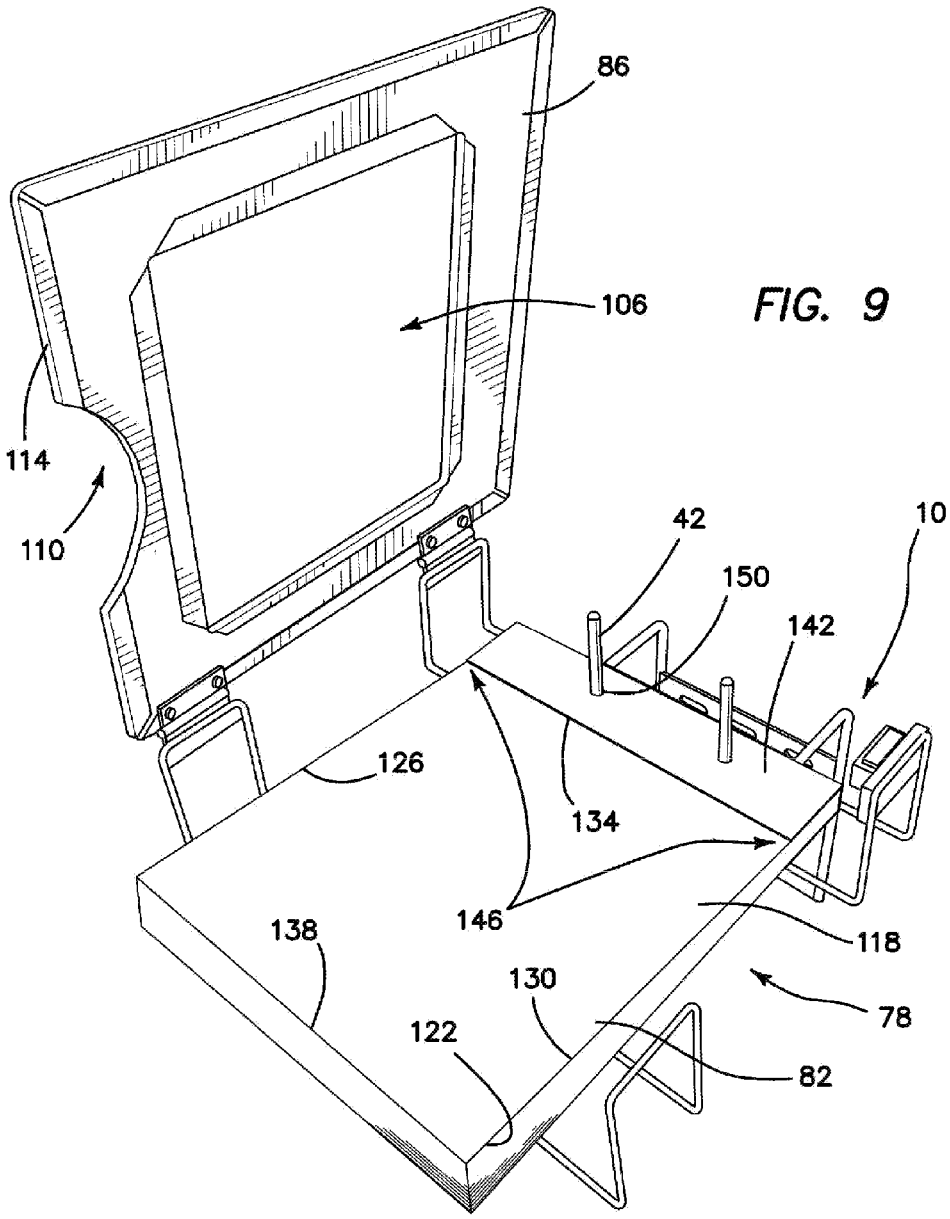
FIG. 9 is a perspective view of the FIG. 3 embodiment with the cover in the open position with a bag stack mounted.
Figure 10:
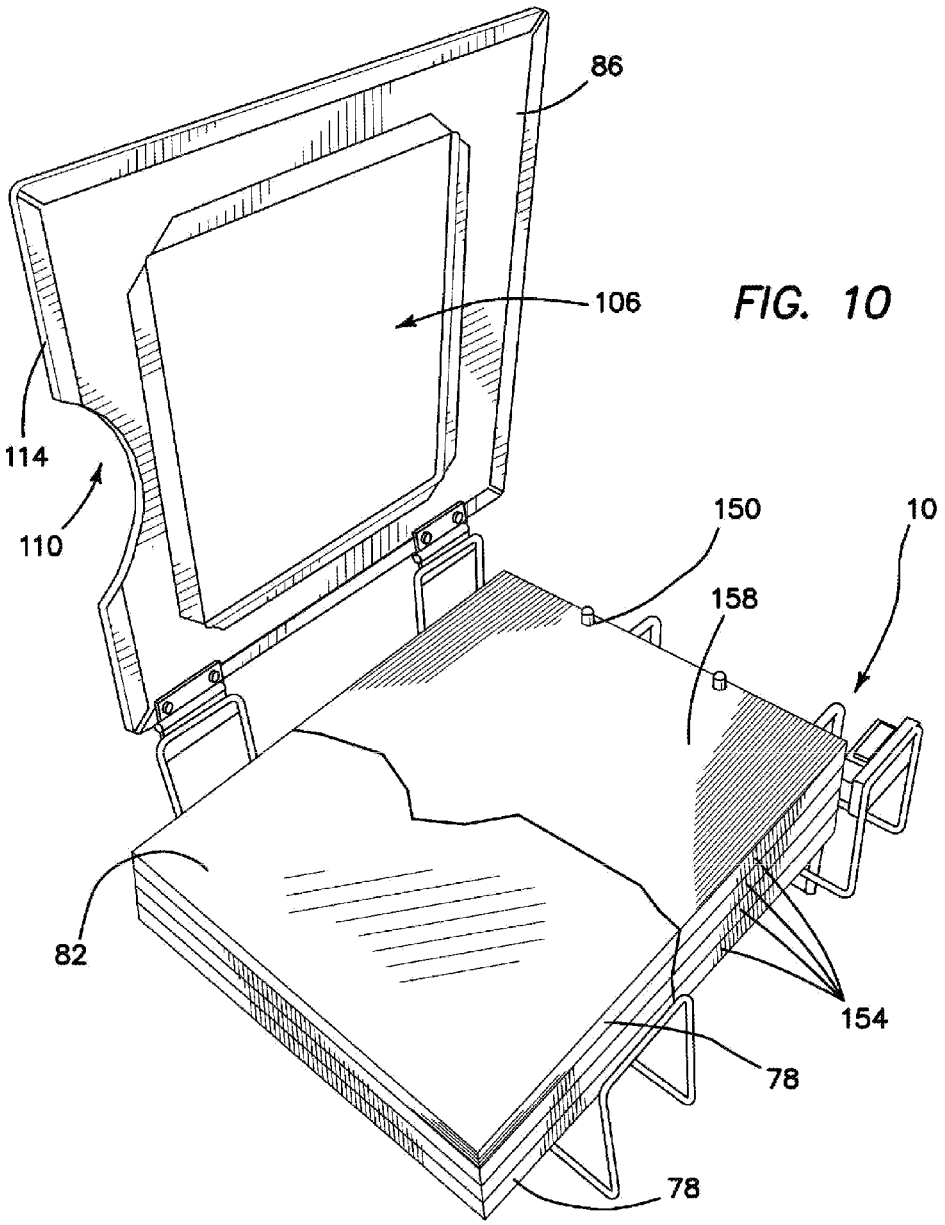
FIG. 10 is a perspective view of the FIG. 3 embodiment with a bag pack containing multiple bag stacks mounted on the dispenser.

(19) In another variant of the invention, as illustrated in FIGS. 7, 9 and 10, the bag dispenser 10 further includes bags 82 for use in the dispenser 10. The bags 82 include a front wall 118, a back wall 122, first 126 and second 130 parallel linear side edges, a top edge 134 and a bottom edge 138.

Figure 20:
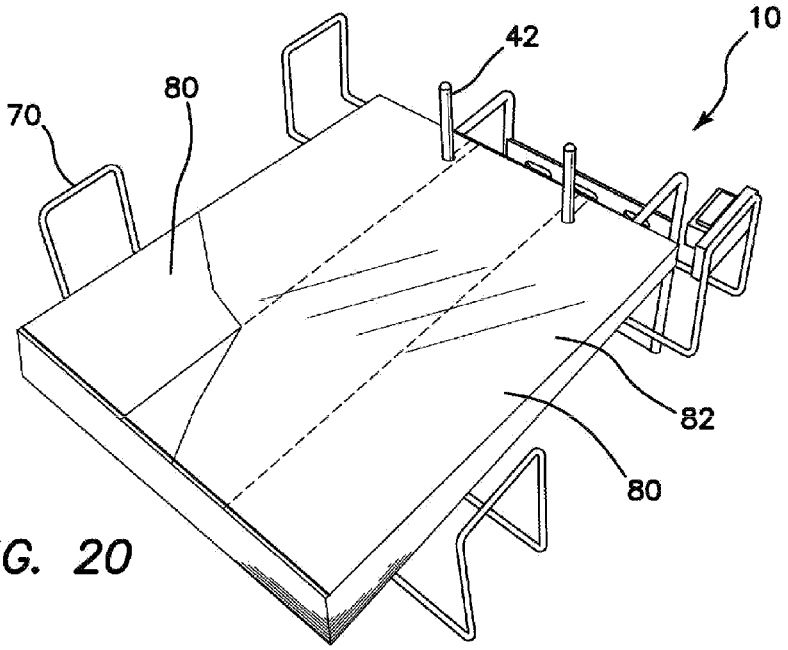
FIG. 20 is a perspective view of the FIG. 3 embodiment illustrating a bag pack having side gussets.
Figure 23:
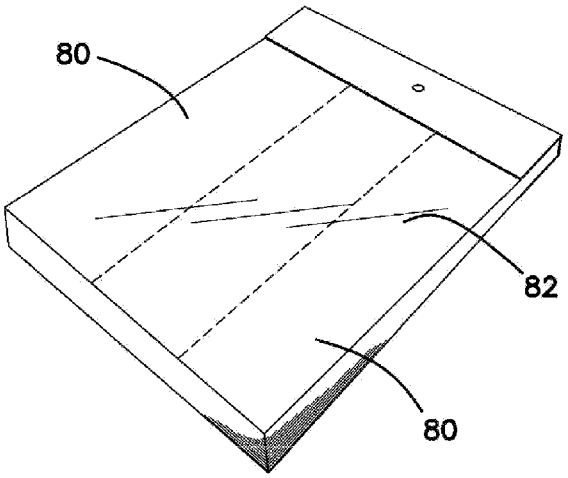
FIG. 23 is a perspective view of a pack of header bags having side gussets for use with the FIG. 3 embodiment of the dispenser.

(20) In still another variant, as illustrated in FIGS. 20 and 23, each of the bags 82 includes at least one longitudinally oriented side gusset 80.

Figure 21:
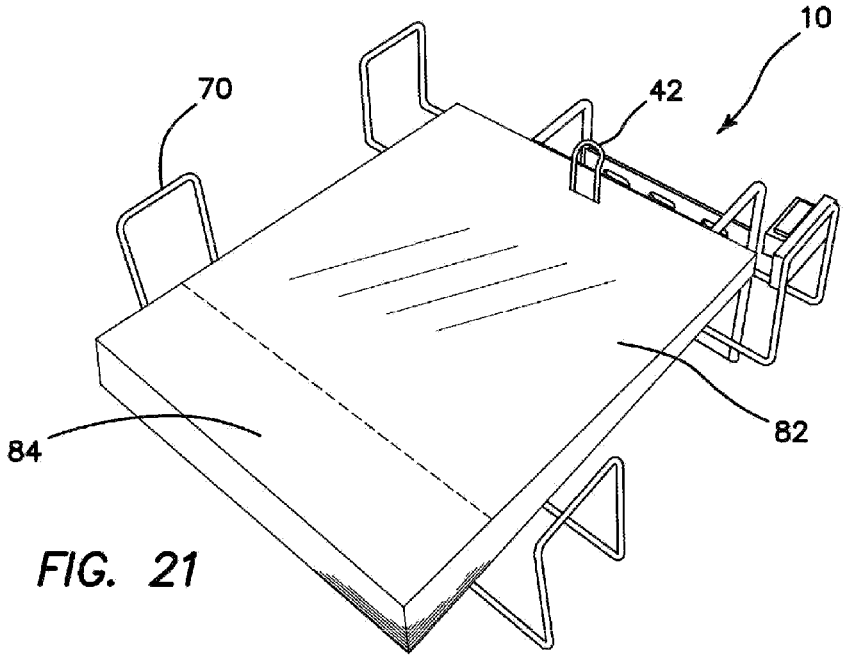
FIG. 21 is a perspective view of the FIG. 3 embodiment illustrating a bag pack having a bottom gusset.
Figure 22:
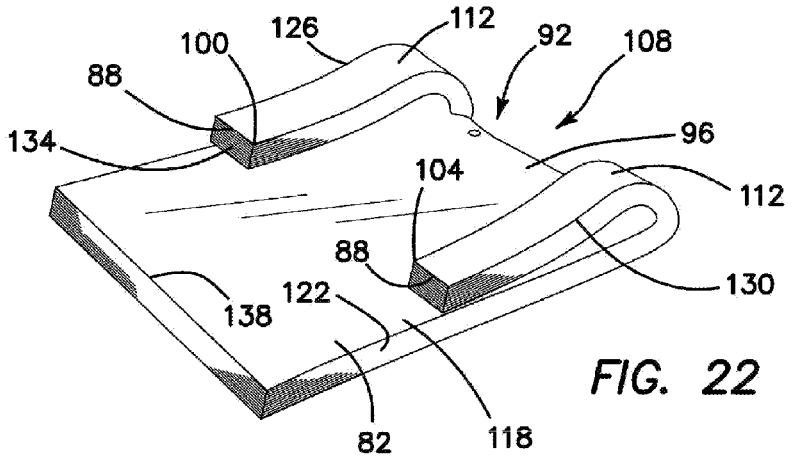
FIG. 22 is a perspective view of a pack oft-shirt style bags for use with the FIG. 3 embodiment of the dispenser.
Figure 24:
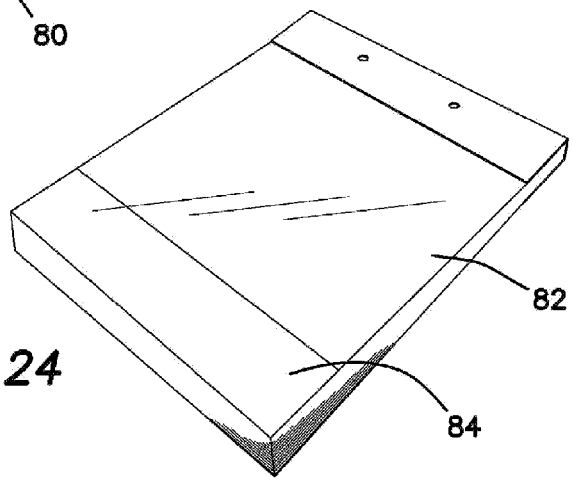
FIG. 24 is a perspective view of a pack of header bags having bottom gussets for use with the FIG. 3 embodiment of the dispenser.

(21) In yet another variant, as illustrated in FIGS. 21 and 24, each of the bags 82 includes a bottom gusset 84.

(22) In a further variant, each of the bags 82 further includes an upper seam 88. The upper seam 88 seals the front wall 118 to the back wall 122 at their respective top edges 134. A U-shaped cut-out 92 is provided. The U-shaped cut-out 92 is located in an upper portion 96 of the bag 82 and commences at a first point 100 along the upper seam 88 spaced inwardly from the first side edge 126 and extends to a second point 104 along the upper seam 88 spaced inwardly from the second side edge 130. The cut-out 92 extends downwardly toward the bottom edges 138, thereby forming an open mouth portion 108 and a pair of bag handles 112.

(23) In still a further variant of the invention, as illustrated in FIGS. 7 and 9, the bag dispenser 10 further includes bags 82 for use in the dispenser 10. The bags 82 include a front wall 118, a back wall 122, first 126 and second 130 parallel linear side edges, a top edge 134 and a bottom edge 138. At least one of the front 118 and back 122 walls is removably attached to a header 142. The header 142 extends across at least a portion 146 of at least one of the front 118 and back 122 walls. The header 142 has at least one mounting aperture 150 extending through the header 142 orthogonally and through the bag walls 118, 122. The mounting aperture 150 is sized, shaped and located to permit the bags 82 to be positioned upon the at least one mounting spike 42.

(24) In yet a further variant, as illustrated in FIGS. 20 and 23, each of the bags 82 includes at least one longitudinally oriented side gusset 80.

(25) In another variant, as illustrated in FIGS. 21 and 24, each of the bags 82 includes a bottom gusset 84.

(26) In still another variant, as illustrated in FIGS. 20-24, a plurality of the bags 82 form a bag stack 78.

(27) In yet another variant, as illustrated in FIGS. 23 and 24, a plurality of the bags 82 attached to the header 142 form a bag stack 78.

(28) In yet another variant, as illustrated in FIG. 10, the bags 82 are packaged into bag packs 154. The bag packs 154 includes at least one stack 78 of bags 82, the stack 78 is enclosed in a removable outer wrapper 158.

(29) In yet another variant, as illustrated in FIG. 10, the bags 82 are packaged into bag packs 154. The bag packs 154 includes at least one stack 78 of bags 82, the stack 78 is enclosed in a removable outer wrapper 158.

Figure 25:
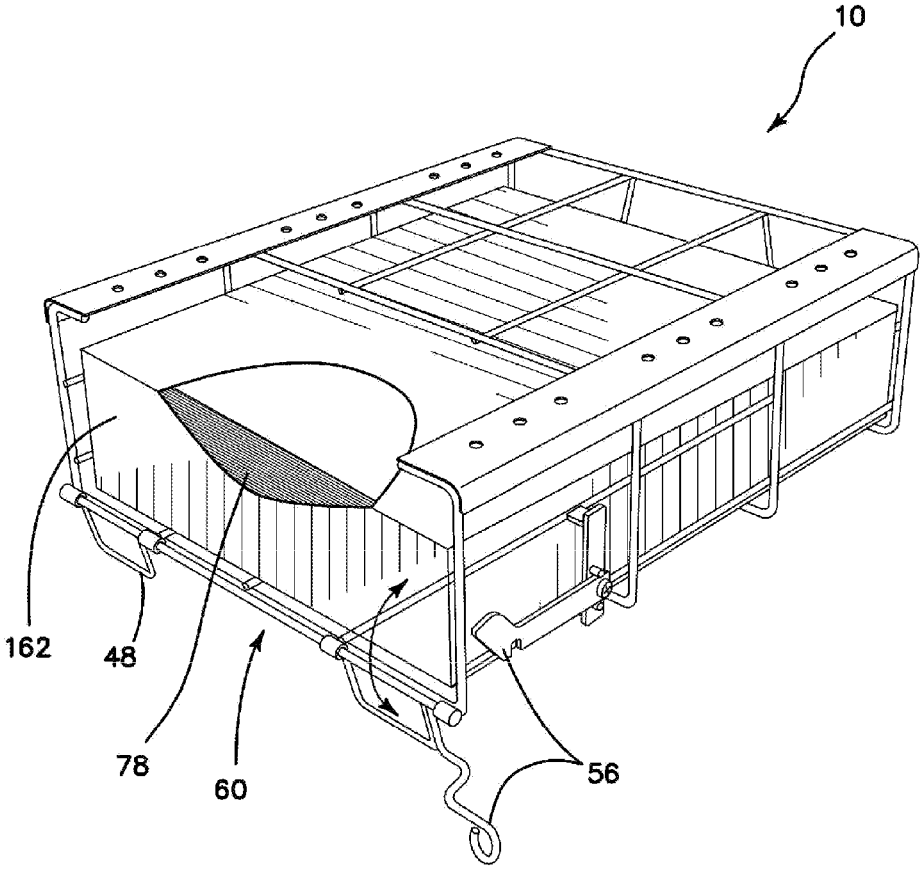
FIG. 25 is a perspective view of the FIG. 17 embodiment with a box of bag packs installed.

(30) In a further variant, as illustrated in FIG. 25, the bag stacks 78 are packaged into boxes 162. The boxes 162 are sized and shaped to fit into the dispenser 10.

(31) In still a further variant of the invention, as illustrated in FIGS. 1-10, a method of using a bag dispenser 10, includes the steps of:

providing a bag platform 14, the platform 14 has a first support surface 18, a first side 22, a second side 26, a first end 30 and a second end 34;

providing a wall mounting plate 46, the plate 46 has an upper end 50, a lower end 54 and a series of apertures 58 penetrating the plate 46 for use in attaching the plate 46 to a vertical surface 62, the plate 46 is attached orthogonally to the second end 34 of the bag platform 14;

providing at least one fastener 66 for attaching the plate 46 to the vertical surface 62;

providing at least one side support 70, the side support 70 extends outwardly from the first 22 and second 26 sides of the bag platform 14 and upwardly from the platform 14, the at least one side support 70 defining a space 74 sized and shaped to accommodate at least one stack 78 of bags 82;

providing a dispenser cover 86, the cover 86 is sized and shaped to extend from the first end 30 to the second end 34 of the bag platform 14 and from at least a first end 90 to at least a second end 94 of the at least one side support 70. The dispenser cover 86 has a central aperture 106 that permits viewing of or access to the stack 78 of bags 82;

attaching the wall mounting plate 46 to the vertical surface 62 using the at least one fastener 66; and positioning the at least one stack 78 of bags 82 in the dispenser 10.

The bag dispensing adapter for a bin 10 and method of using same has been described with reference to particular embodiments. Other modifications and enhancements can be made without departing from the spirit and scope of the claims that follow.

The invention claimed is:

1. A bag dispenser comprising:

a bag platform, said platform having a first support surface, a first side, a second side, a first end and a second end;

a wall mounting plate, said plate having an upper end, a lower end and a series of apertures penetrating said plate for use in attaching said plate to a vertical surface, said plate being attached orthogonally to either said first end or said second end of said bag platform;

at least one fastener for attaching said plate to said vertical surface;

at least one side support, said side supports extending outwardly from said first and second sides of said bag platform and then upwardly from said platform, said side supports defining a space sized and shaped to accommodate at least one stack of bags;

a dispenser cover, said cover being sized and shaped to extend from said first end to said second end of said bag platform and from at least a first end to at least a second end of said side supports;

said dispenser cover having a central aperture permitting either of viewing of and access to said stack of bags;

an opening, said opening disposed at either said first end or said second end of said bag platform, opposite attachment of said wall mounting plate;

said opening extending from an upper surface of a horizontal portion of said side support to a lower surface of said dispenser cover and from said first end to said second end of said side supports; and said opening adapted to permit dispensing of bags from said bag stack.

2. The bag dispenser, as described in claim 1, wherein said bag platform extends downwardly at said second end, providing at least one attachment point for said wall mounting plate.

3. The bag dispenser, as described in claim 1, wherein said at least one side support extends across and attaches to said bag platform.

4. The bag dispenser, as described in claim 1, wherein said at least one side support is of wire frame construction.

5. The bag dispenser, as described in claim 1, wherein said dispenser cover is hingedly attached to said at least one side support at said first end of said side support.

6. The bag dispenser, as described in claim 1, wherein said dispenser cover has a cutout at one edge for lifting said cover.

7. The bag dispenser, as described in claim 1, wherein said dispenser cover is pivotally attached to said first end of said at least one side support.

8. The bag dispenser, as described in claim 7, wherein said at least one side support has a latching mechanism adjacent said second end for securing said dispenser cover.

9. The bag dispenser, as described in claim 8, wherein said latching mechanism is magnetic.

10. The bag dispenser as described in claim 1, further comprising a mounting spike fixture, said mounting spike fixture being attached parallel to said platform and having at least one mounting spike extending upwardly therefrom.

11. The bag dispenser, as described in claim 10, wherein said at least one mounting spike is removably attached to a slot in said mounting spike fixture.

12. The bag dispenser, as described in claim 1, further comprising bags for use in said dispenser, said bags comprising:

front and rear walls, each of said front and rear walls having first and second side edges, a top edge and a bottom edge; and said front and rear walls being integrally joined at their first and second side edges and secured together at their bottom edges and defining an open mouth portion adjacent said top edges.

13. The bag dispenser, as described in claim 12, wherein each of said bags includes at least one longitudinally oriented side gusset.

14. The bag dispenser, as described in claim 12, wherein a plurality of said bags comprise a bag stack.

15. The bag dispenser, as described in claim 14, wherein said bag stacks are packaged into bag packs, said bag packs comprising at least one stack of bags, said stack being enclosed in a removable outer wrapper.

16. A method of using a bag dispenser, comprising the steps of:

providing a bag platform, said platform having a first support surface, a first side, a second side, a first end and a second end;

providing a wall mounting plate, said plate having an upper end, a lower end and a series of apertures penetrating said plate for use in attaching said plate to a vertical surface, said plate being attached orthogonally to either said first end or said second end of said bag platform;

providing at least one fastener for attaching said plate to the vertical surface;

providing at least one side support, said side supports extending outwardly from said first and second sides of said bag platform and then upwardly from said platform, said side supports defining a space sized and shaped to accommodate at least one stack of bags;

providing a dispenser cover, said cover being sized and shaped to extend from said first end to said second end of said bag platform and from at least a first end to at least a second end of said side supports, said dispenser cover having a central aperture permitting either of viewing of and access to said stack of bags;

providing an opening, said opening disposed at either of said first end or said second end of said bag platform, opposite attachment of said wall mounting plate;

said opening extending from an upper surface of a horizontal portion of said side support to a lower surface of said dispenser cover and from said first end to said second end of said side supports;

said opening adapted to permit dispensing of bags from said bag stack;

securing said dispensing cover over said at least one stack of bags;

attaching said wall mounting plate to said vertical surface using said at least one fastener; and positioning said at least one stack of bags in said dispenser.

* * * * *